US006089154A

United States Patent [19]

Masaki et al.

[11] Patent Number: 6,089,154

[45] Date of Patent: Jul. 18, 2000

[54] THIN FILM FORMING DEVICE

[75] Inventors: Kenichi Masaki; Shinya Yamada; Daisuke Miura, all of Kyoto, Japan

[73] Assignee: Nissha Printing Co., Ltd., Kyoto, Japan

[21] Appl. No.: 09/142,450

[22] PCT Filed: Mar. 13, 1997

[86] PCT No.: PCT/JP97/00793

§ 371 Date: Sep. 8, 1998

§ 102(e) Date: Sep. 8, 1998

[87] PCT Pub. No.: WO97/34187

PCT Pub. Date: Sep. 18, 1997

[30] Foreign Application Priority Data

Mar. 15, 1996 [JP] Japan ..... 8-087294

[51] Int. Cl.[7] ..... B41F 9/00

[52] U.S. Cl. ..... 101/153; 101/216; 101/217

[58] Field of Search ..... 101/150, 153, 101/216, 217, 212, 218, 219, 142, 177, 136, 137, 35

[56] References Cited

U.S. PATENT DOCUMENTS

| | | | |
|---|---|---|---|
| 3,021,783 | 2/1962 | Casey | 101/35 |
| 4,200,045 | 4/1980 | Toropainen | 101/217 |
| 4,494,457 | 1/1985 | Schwartz et al. | 101/217 |
| 4,827,284 | 5/1989 | Ogiwara | 101/153 |
| 5,809,883 | 9/1998 | Rodi | 101/216 |

FOREIGN PATENT DOCUMENTS

| | | | |
|---|---|---|---|
| 2 527 518 | 12/1983 | France . | |
| 1 047 794 | 12/1958 | Germany . | |
| 804535 | 2/1981 | U.S.S.R. | 101/153 |

*Primary Examiner*—Christopher A. Bennett
*Attorney, Agent, or Firm*—Wenderoth, Lind & Ponack, L.L.P.

[57] ABSTRACT

A thin film formation apparatus includes a printing roll having an elastic letterpress of resin or rubber fitted at a part of a surface of a cylinder part and, an intaglio roll rotating while facing the printing roll, thereby transferring ink to a surface of the elastic letterpress through contact with the printing roll. The thin film formation apparatus further includes a pair of printing roll side contact bodies on a drum portion or a rotating shaft of the printing roll, and a pair of intaglio roll side contact bodies on a drum portion or a rotating shaft of the intaglio role. The printing roll side contact bodies and the intaglio roll side contact bodies continuously contact each other, at least before and during the contact of the elastic letterpress with the intaglio roll, to form a thin film of uniform film thickness.

15 Claims, 6 Drawing Sheets

THIN FILM FORMING DEVICE

TECHNICAL FIELD

The present invention relates to a thin film formation apparatus which can print and apply thin films of a uniform thickness precisely during film formation in a process for the manufacture of electronic components.

BACKGROUND ART

A conventional thin film formation apparatus comprises, as shown in FIG. 9, at least a printing roll 3 having a elastic letterpress 31 of resin or rubber fitted at a part of a surface of a cylinder part 30, and an intaglio roll (Anilox roll) 4 rotating while facing the printing roll 3, thereby transferring ink to a surface of the elastic letterpress 31 through contact with the printing roll 3. In the apparatus of such constitution, ink is transferred to a surface of a body to be printed (plate glass, plastic plate, film that can be wound in a roll, etc.) by pressing the elastic letterpress 31 into contact with the body to be printed, so as to form a thin film by printing.

In such thin film formation apparatus, while the cylinder part 30 of the printing roll 3, specifically a part without the elastic letterpress 31, and a non-printing image part never came into contact with the intaglio roll 4 (with reference to FIG. 12A), a printing image part of the letterpress 31 of the printing roll 3 is brought into contact with the intaglio roll 4 (referring to FIGS. 7, 12B). Contact is also maintained in a driving system, for example, between pinions of rotary shafts 6 of the intaglio roll 4 and the printing roll 3.

A primary usage of the thin film formation apparatus is to form liquid crystal orientation films in a process for production of electronic components such as display panels of liquid crystal display devices, etc. Although the liquid crystal orientation film of the display panel is naturally required to be uniform in thickness, the display panel increasingly has become larger in size and ofhigher image quality, and accordingly film thickness uniformity with higher accuracy is demanded.

Meanwhile, a drive environment for the thin film formation apparatus permits only an expensive clean room to avoid minute dust during forming the thin films such as liquid crystal orientation films or the like. The thin film formation apparatus is therefore required to be compact and light-weight in order to economically assure use of a space in the clean room that is as small as possible.

On the other hand, in order to form thin films of high accuracy, it is necessary that a resin liquid as the ink has a viscosity as low as 50–100 cp in comparison with a flexographic ink, a thin elastic letterpress is used to secure size accuracy thereof, and it is necessary to compensate for rattling and bending of rotary shafts of the printing roll and the intaglio roll. As such, a contact pressure between the elastic letterpress and intaglio roll is generally large compared with that in the case of flexography, and thereby it is necessary to transfer uniformly the ink from an ink hold part of the intaglio roll to the elastic letterpress. The contact pressure is measured by the amount of the letterpress 31 is pressed by the intaglio roll 4 (referring to FIG. 7). The "pressed amount" is a difference of thickness of the elastic letterpress 31 between when the printing image part of the letterpress 31 is not pressed by a surface of the intaglio roll 4 and when the printing image part of the letterpress 31 is depressed by the intaglio roll 4.

The above-described requirements lead to the following problems.

During the rotation of the printing roll 3 and intaglio roll 4, a contact state (referring to FIGS. 7, 12B) and a non-contact state (referring to FIG. 12A) are alternatively brought about between the elastic letterpress 31 and intaglio roll 4. Because of the large contact pressure between the letterpress 31 and intaglio roll 4 exerted during the contact state, the intaglio roll 4 collides sideways to the printing image part of the letterpress 31 when the non-contact state is changed to the contact-state, that is when the surface of the intaglio roll 4 rides over the surface of the elastic letterpress 31 (referring to FIG. 12B). Impacts and reaction from the elastic letterpress 31 at this time are transmitted to the rotary shafts 6 of the printing roll 3 and intaglio roll 4, which in turn vibrates the printing roll 3 and intaglio roll 4 due to a play of bearings 5 or play 100 between the rotary shafts 6 and inner rings of the bearings (referring to FIGS. 9, 10). Microscopically, the printing roll 3 and intaglio roll 4 rotate in the state of contact with each other. The printing roll 4 prints while in contact with the body to be printed.

When the letterpress 31 of the printing roll 3 and intaglio roll 4 are turned from the non-contact state to the contact state, in other words when the surface of the intaglio roll 4 rides over the surface of the letterpress 31, the printing roll 3 including the cylinder part 30 and the intaglio roll 4 are undesirably bent and, as a reaction to such bending, the printing roll 3 and intaglio roll 4 are vibrated. In consequence, microscopically the printing roll 3 and intaglio roll 4 rotate while bending and in contact with each other. The printing roll 3 while bending performs printing on the body to be printed (referring to FIG. 10).

As a result, stripe patterns (where the amount of ink transferred or thickness of a film formed by ink is alternately changed from large to small) are formed at the letterpress 31 and the body to be printed, at positions spaced in an axial direction of the roll.

Therefore, the present invention is devised to avoid the above-described disadvantages, and has for its object to provide a thin film formation apparatus capable of forming thin films of uniform thickness.

SUMMARY OF THE INVENTION

In order to achieve the aforementioned objective, according to the present invention, a thin film formation apparatus is constituted as follows.

In a first aspect of the present invention, there is provided a thin film formation apparatus including a printing roll having a resin or rubber elastic letterpress fitted at a surface thereof, and an intaglio roll for transferring ink to a surface of the elastic letterpress through contact with the printing roll. Contact members are provided at the printing roll and intaglio roll for absorbing or easing contact impacts upon contact between the intaglio roll and the elastic letterpress of the printing roll by contacting the contact members with each other prior to the contact between the intaglio roll and the elastic letterpress, According to a second aspect of the present invention, the contact members are constructed as a pair of printing roll contact bodies at a cylinder part or a rotary shaft of the printing roll, and a pair of intaglio roll contact bodies at a cylinder part or a rotary shaft of the intaglio roll. Such contact bodies are in contact with each other continuously at least before the elastic letterpress comes into contact with the intaglio roll and throughout such contact, thereby to absorb or ease contact impact between the intaglio roll and the elastic letterpress ofthe printing roll.

According to a third aspect of the present invention, the contact bodies are adapted to be in contact with each other continuously at least before the elastic letterpress comes into contact with the intaglio roll and throughout such contact, thereby to absorb or ease contact impact between the intaglio roll and the elastic letterpress ofthe printing roll, whereby before the elastic letterpress and the intaglio roll start to come into contact with each other, a stress resulting from the contact between the printing roll contact bodies and the intaglio roll contact bodies restricts bending of the cylinder part of the printing roll inside the pair of the printing roll contact bodies or the rotary shaft of the printing roll, or/and the cylinder part of the intaglio roll inside the pair of the intaglio roll contact bodies or rotary shaft of the intaglio roll.

According to a fourth aspect of the present invention, the contact bodies are adapted to be in contact with each other continuously at least before the elastic letterpress comes into contact with the intaglio roll and throughout such contact, thereby to absorb or ease contact impact between the intaglio roll and the elastic letterpress of the printing roll, whereby a stress resulting from the contact between the printing roll contact bodies and the intaglio roll contact bodies presses the printing roll and the intaglio roll in directions opposite to directions in which the rolls are pressed into contact with each other, by the amount of play of bearings supporting the respective rotary shafts of the printing roll and the intaglio roll in a rotatable fashion and a play between each rotary shaft at a bearing part of the bearing and an inner ring of the bearing, thereby to substantially reduce such play.

According to a fifth aspect of the present invention, the pair of intaglio roll contact bodies are set at the cylinder part of the intaglio roll and a pair of projections or grooves are formed between an ink hold part of the intaglio roll and the intaglio roll contact bodies so as to prevent ink from flowing from the ink hold part to the intaglio roll contact bodies.

According to the sixth aspect of the present invention, a resin or rubber elastic body is fitted at a surface of at least either of the printing roll contact bodies and the intaglio roll contact body.

According to the seventh aspect of the present invention, the resin or rubber elastic body fitted at a surface of at least either of the printing roll contact bodies and the intaglio roll contact bodies is formed of the same or same series materials as that of the elastic letterpress mounted to the printing roll.

According to an eighth aspect of the present invention, the elastic body is fitted in an exchangeable manner at a surface of the printing roll contact bodies or the intaglio roll contact bodies, whereby a contact pressure between the elastic letterpress of the printing roll and the surface of the intaglio roll is changed by changing one of breadth, thickness and hardness of at least one of the elastic bodies.

BRIEF DESCRIPTION OF DRAWINGS

These and other objects and features of the present invention will become clear from the following description taken in conjunction with preferred embodiments thereof with reference to the accompanying drawings, in which.

DETAILED DESCRIPTION OF THE INVENTION

Figure 1:
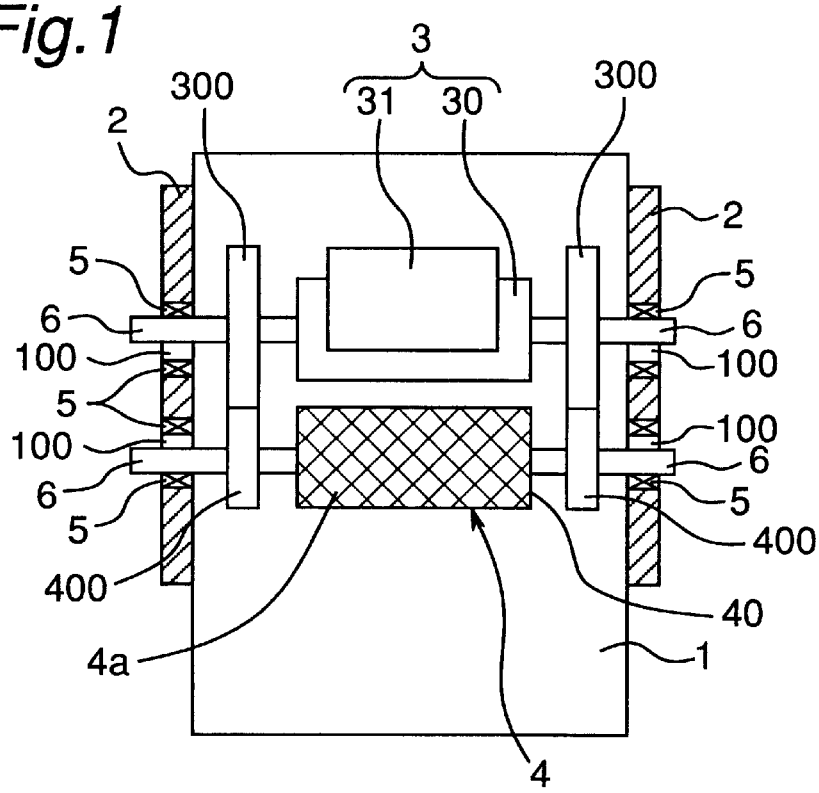
FIG. 1 is a partly sectional plan view of a thin film formation apparatus according to a first embodiment of the present invention.

Before the description of the present invention proceeds, it is to be noted that like parts are designated by like reference numerals throughout the accompanying drawings.

Embodiments of the present invention will be described in more detail with reference to the drawings.

Figure 2:
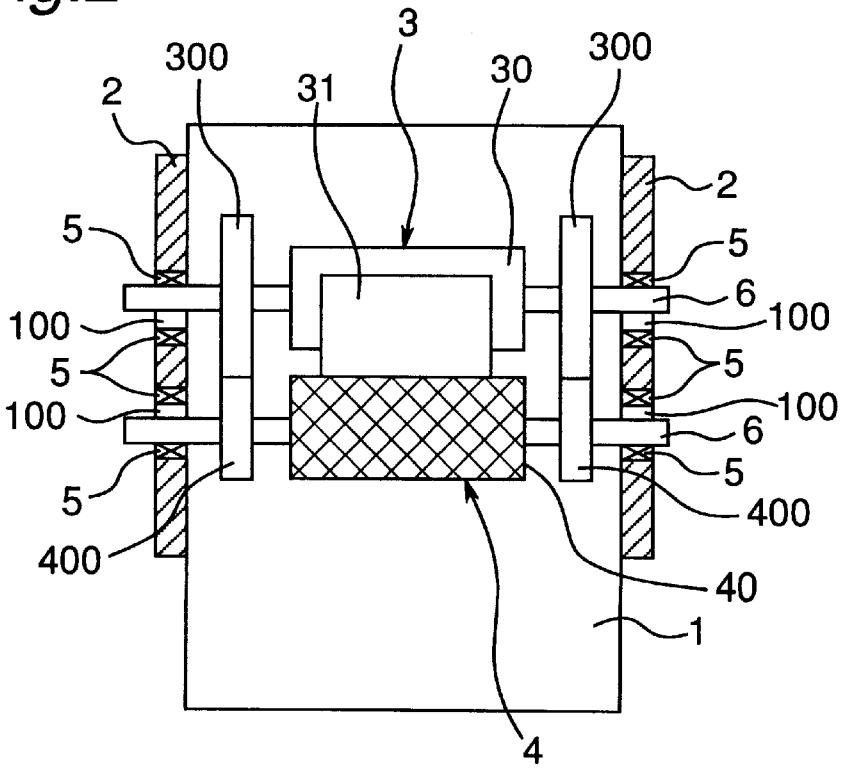
FIG. 2 is a partly sectional plan view of the thin film formation apparatus in the first embodiment of the present invention.
Figure 3:
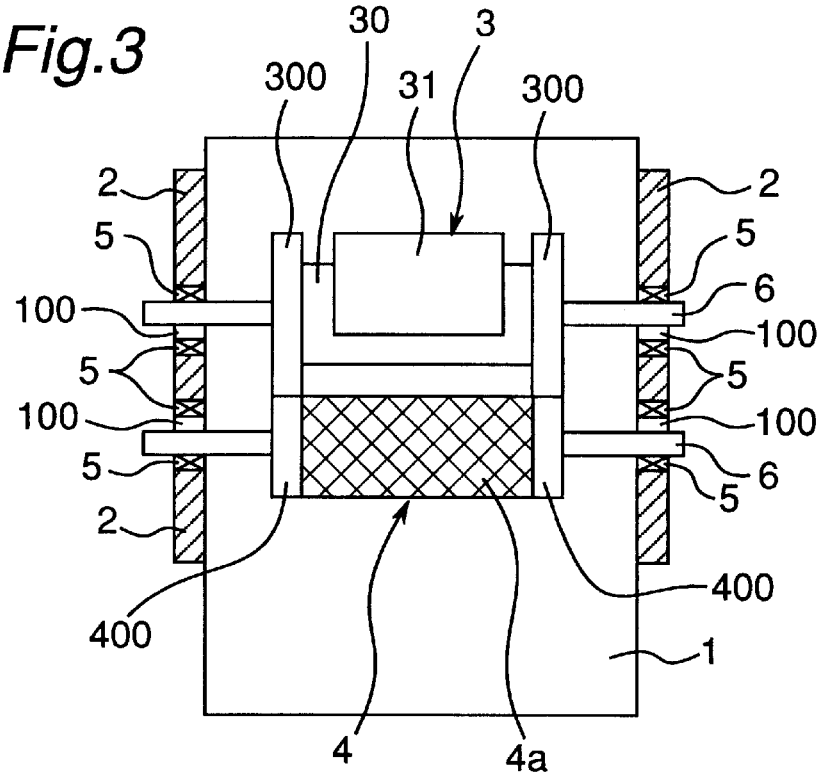
FIG. 3 is a partly sectional plan view of a thin film formation apparatus according to a second embodiment of the present invention.
Figure 4:
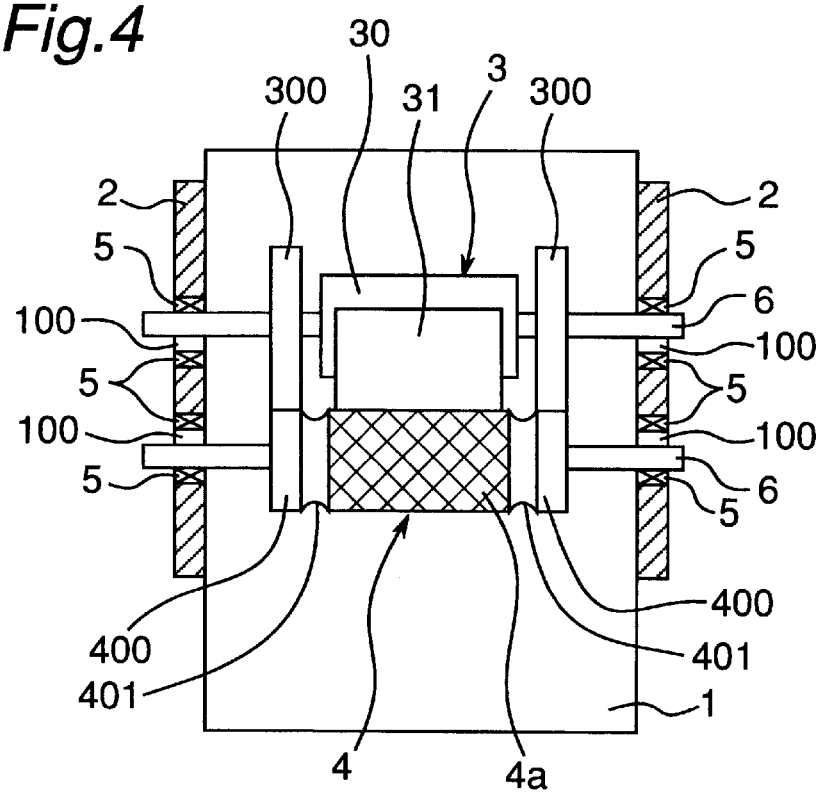
FIG. 4 is a partly sectional plan view of a thin film formation apparatus according to a third embodiment of the present invention.
Figure 5:
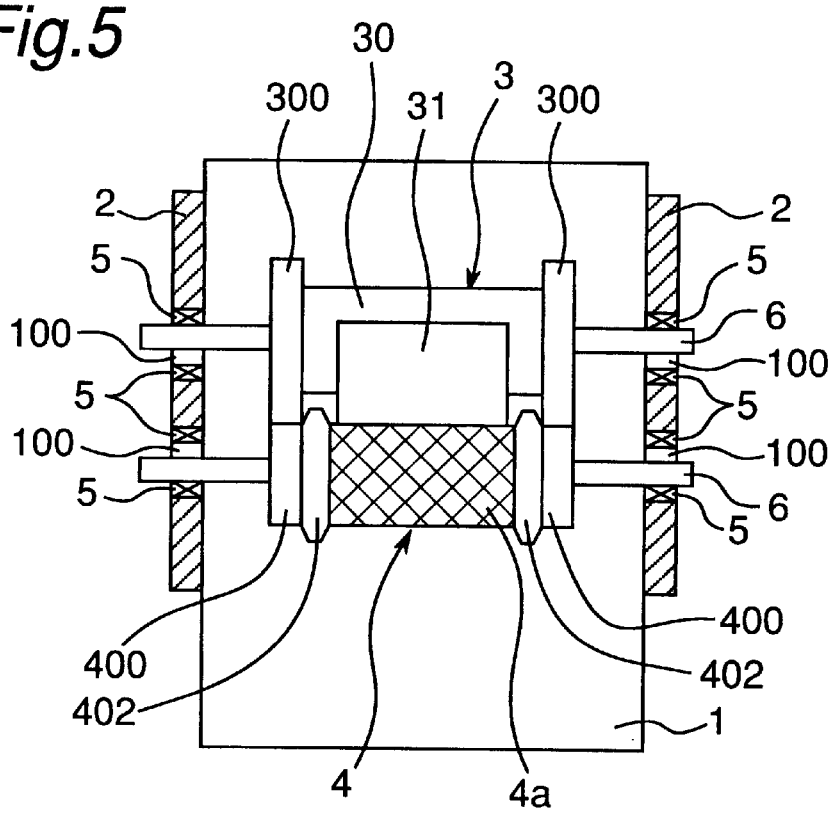
FIG. 5 is a partly sectional plan view of a thin film formation apparatus according to a fourth embodiment of the present invention.
Figure 6:
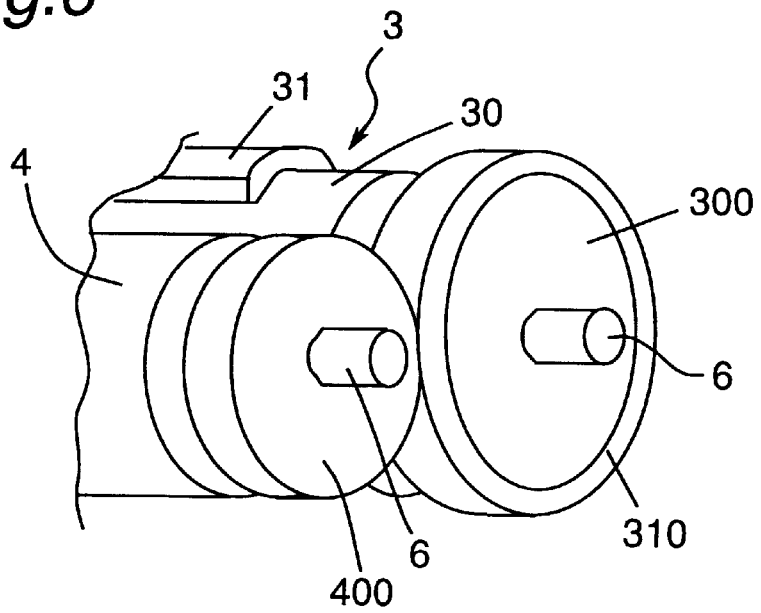
FIG. 6 is a perspective view of an example of contact bodies of a thin film formation apparatus according to a fifth embodiment of the present invention.
Figure 7:
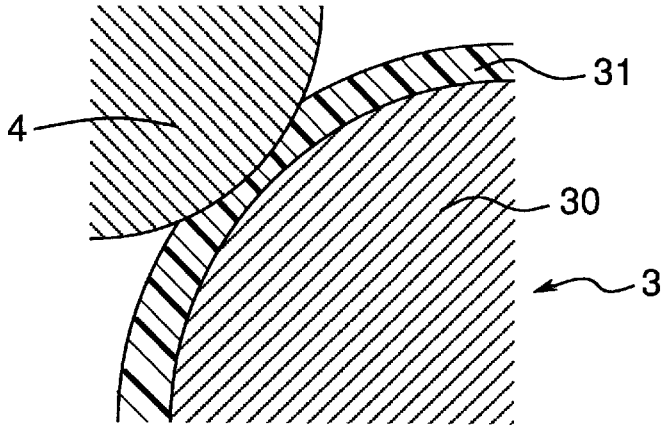
FIG. 7 is a diagram explanatory of a contact state (pressed state) between a printing roll and an intaglio roll of a thin film formation apparatus.
Figure 8:
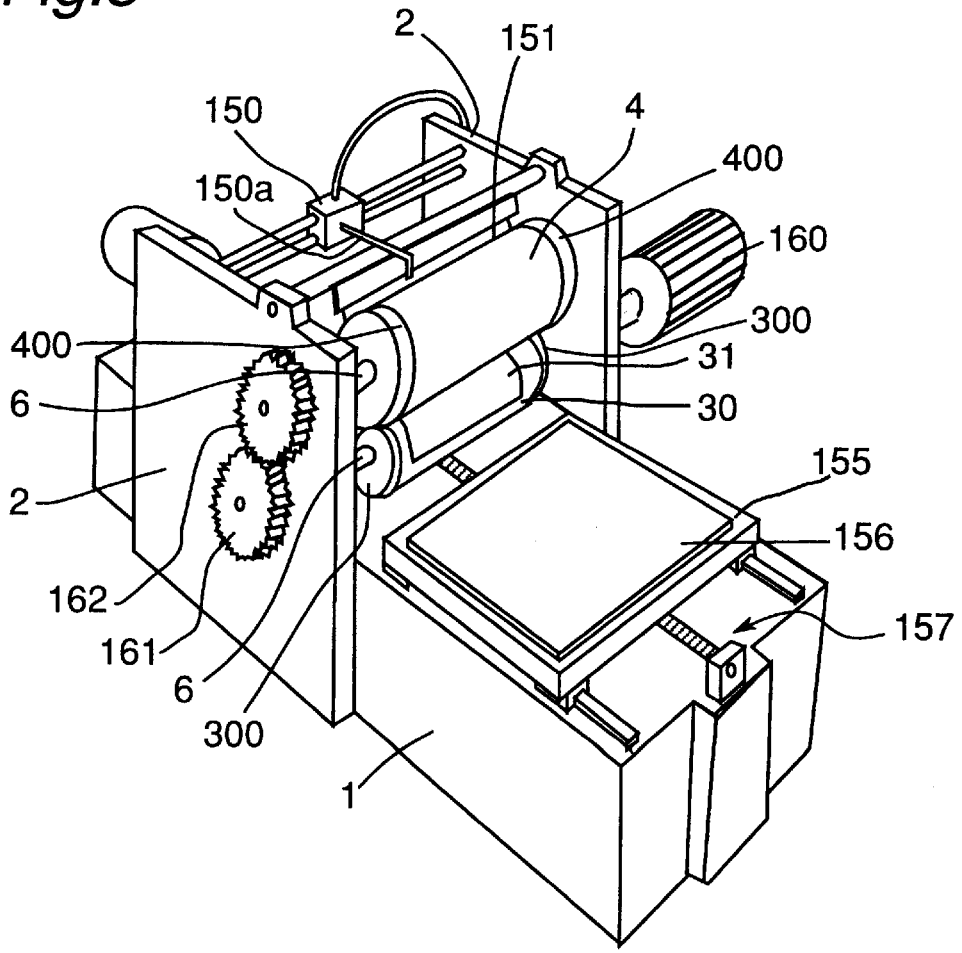
FIG. 8 is a perspective view of the thin film formation apparatus in each of the above embodiments of the present invention.
Figure 9:
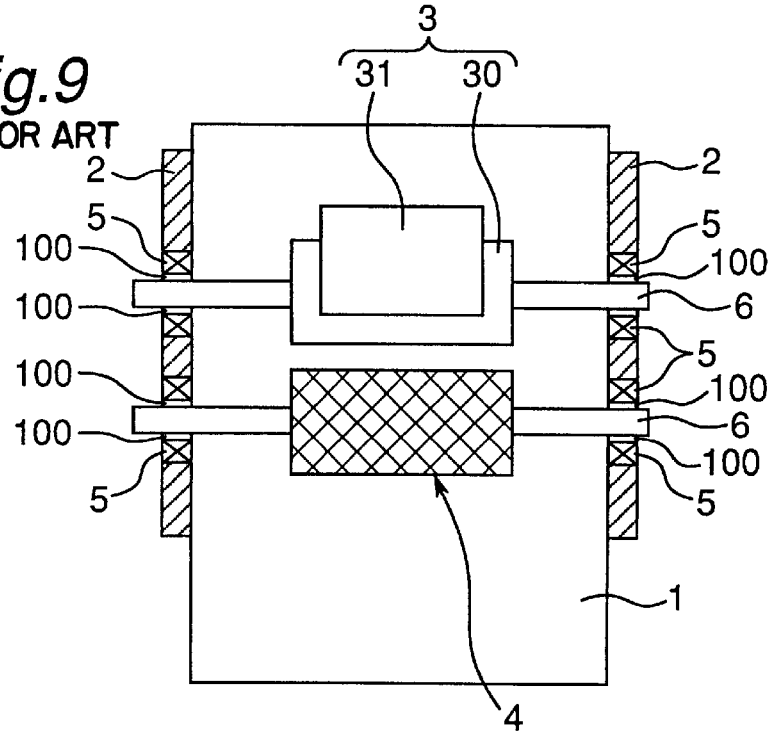
Fig.9 PRIOR ART
FIG. 9 is a plan view of a conventional thin film formation apparatus.
Figure 10:
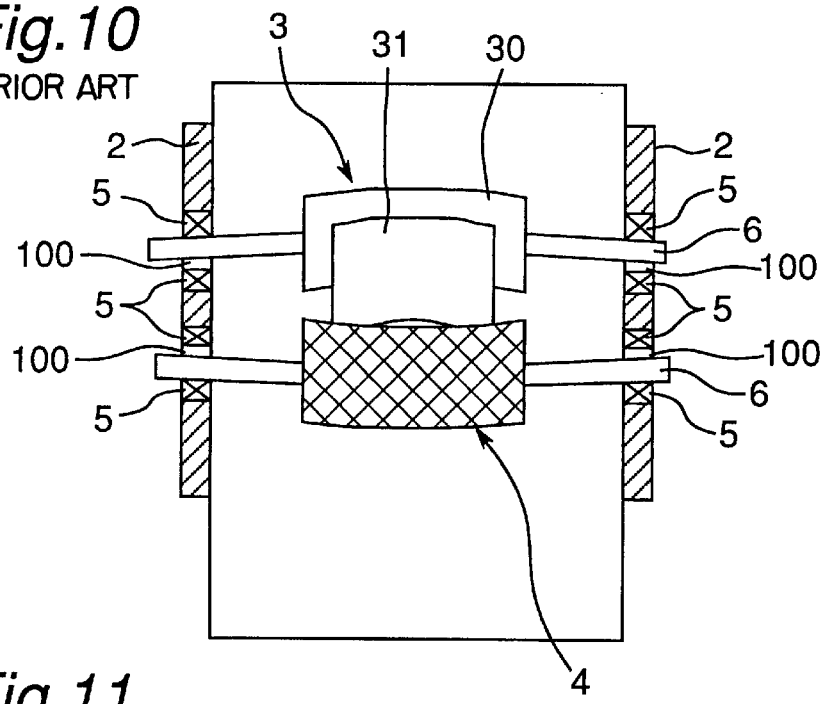
Fig.10 PRIOR ART
FIG. 10 is a plan view of another conventional thin film apparatus.

FIGS. 1, 2 are plan views, partly sectional, of a thin film formation apparatus according to a first embodiment of the present invention. FIGS. 3–5 are plan views, partly sectional, of thin film formation apparatuses according to second to fourth embodiments of the present invention. FIG. 6 is a perspective view of an example of contact bodies of a thin film formation apparatus according to a fifth embodiment of the present invention. FIG. 7 is a sectional view explanatory of a pressed amount. FIG. 8 is a perspective view of one example of the thin film formation apparatus according to any of the above embodiments. In the drawings, reference numerals represent respectively: 1 a base, 2 a supporting frame, 3 a printing roll, 4 an intaglio roll having an ink hold part 4*a* for holding ink, 5 a bearing, 300 a printing roll contact body and 400 an intaglio roll contact body.

As shown in FIGS. 1–5, in the thin film formation apparatus according to any of the above embodiments of the present invention, supporting frames 2 are provided at both lateral sides of the base 1. The bearings 5 for receiving ends of rotary shafts 6 of the printing roll 3 and intaglio roll 4 are fixed to both supporting frames 2. The intaglio roll 4 and the printing roll 3 are supported in a rotatable fashion in the supporting frames 2 via respective bearings 5. The intaglio roll 4 and the printing roll 3 rotate synchronously or rotate at different peripheral velocities while in contact with each other. Because of a contact between the intaglio roll 4 and an elastic letterpress 31 of the printing roll 3, rotary shafts 6 of the intaglio roll 4 and printing roll 3 are pressed toward inner rings of the bearings 5. The thin film formation apparatus according to each of the embodiments of the present invention can be designed to include above the intaglio roll 4, as illustrated in FIG. 8, an ink feed device 150 for supplying ink from an ink nozzle 150*a* to the intaglio roll 4, a doctor blade 151 for filling the ink fed to the intaglio roll 4 to the ink hold part of the intaglio roll 4 and thus holding a specified amount of ink therein, etc. Moreover, a printing table 155 is arranged at an upper face of the base 1, on which a body 156 to be printed is loaded. The body 156 to be printed may be printed by the elastic letterpress 31 of the printing roll 3 while the body 156 is reciprocated by a drive device 157 under the printing roll 3. In FIG. 8, 160 denotes a driving motor that is connected to one end of the rotary shaft 6 of the printing roll and that drives and rotates the printing roll 3 via the rotary shaft 6. 161 denotes a first pinion which is fixed to the other end of the rotary shaft 6 of the printing roll 3. 162 denotes a second pinion which is fixed to one end of the rotary shaft 6 of the intaglio roll 4 and always meshes with the first pinion 161 so as to rotate the rotary shaft 6 of the intaglio roll 4 synchronously with the rotation of the first pinion 161. Both the printing roll 3 and the intaglio roll 4 may be driven by one motor 160 described above.

The printing roll 3 has a cylinder part 30 having the elastic letterpress 31 and secured to the rotary shaft 6. The elastic letterpress 31 is a plate for transferring the ink transferred to a surface thereof from the ink hold part 4a of the intaglio roll 4 to the body 156 to be printed. The elastic letterpress 31 is set at a predetermined point of a surface of the cylinder part 30 of the printing roll 3. The elastic letterpress 31 is formed of, e.g., rubber such as butyl rubber, synthetic resin such as nylon resin, photosensitive rubber or photosensitive resin, or the like. The elastic letterpress 31 has a printing image part to which the ink is transferred from the intaglio roll 4. The letterpress 31 may include a non-printing image part which does not protrude and to which the ink is not transferred.

A pair of printing roll contact bodies 300 may be fixed to the rotary shaft 6 separately from the cylinder part 30 of the printing roll 3, as in the first embodiment shown in FIGS. 1 and 2 and the third embodiment shown in FIG. 4. Alternatively, the printing roll contact bodies 300 may be disposed at both ends of the cylinder part 30 of the printing roll 3 so as to hold the elastic letterpress 31 between them, as in the second embodiment of FIG. 3 and the fourth embodiment of FIG. 5. The surface of the cylinder part 30 of the printing roll 3 itself may be utilized as the printing roll contact body 300.

The disk-like contact body 300 may be provided along the entire circumference of the cylinder part 30 or the rotary shaft 6 of the printing roll 3, or a contact body 300 shaped like a fan may be arranged at a part of the circumference of the cylinder part 30 or the rotary shaft 6 of the printing roll 3.

The contact body 300 may have a diameter equal to a total thickness of the cylinder part 30 and the elastic letterpress 31. A larger or smaller diameter than the above can be employed. The diameter of the printing roll contact body 300 is variable within an allowance of approximately ±2.0 mm.

The intaglio roll 4 has a cylinder part fixed to the rotary shaft 6. The intaglio roll 4 rotates in synchronization with the printing roll 3 or at a different peripheral velocity therefrom. A plating layer is formed on a surface of an iron core of the cylinder part, with many ink cells formed at a surface thereof. The ink cells are the ink hold 4*a* and each have a depth of, for instance, 10-several tens $\mu$m. The cylinder part of the intaglio roll comes into contact with the elastic letterpress 31 of the cylinder part 30 of the printing roll 3 at a constant pressure. In one example, the second pinion 162 may be fixed to one end of the rotary shaft 6 of the intaglio roll 4, so that the rotary shaft of the intaglio roll 4 is coupled to the first pinion 161 of the printing roll 3, as in FIG. 8. Otherwise, an intaglio roll driving motor may be installed at one end of the rotary shaft 6 of the intaglio roll 4, without such rotary shaft 6 being coupled to the first pinion of the printing roll 3.

As in the first embodiment shown in FIGS. 1 and 2 and the third embodiment of FIG. 4, each of a pair of intaglio roll contact bodies 400 may be separated from the cylinder part 40 of the intaglio roll 4 and fixed to the rotary shaft 6. However, the intaglio roll contact bodies 400 may be arranged at both end of the cylinder part 40 of the intaglio roll 4 via the link hold part 4*a*, as in the second embodiment of FIG. 3 and the fourth embodiment shown in FIG. 5. The intaglio roll contact body 400 may be the surface of the cylinder part 40 of the intaglio roll 4 itself.

The intaglio roll contact body 400 may be a disk-shaped body extending along the entire circumference of the cylinder part 40 or the rotary shaft 6 of the intaglio roll 4. Or, a fan-shaped intaglio roll contact body may be fitted at a part of the circumference of the cylinder part 40 or the rotary shaft 6 of the intaglio roll 4. The intaglio roll contact body 400 is at a position opposite to a respective printing roll contact body 300.

A diameter of the contact body 400 may be equal to, or larger or smaller than that of the cylinder part 40, in other words variable with an allowance of approximately ±2.0 mm to a diameter of the cylinder part 40.

Both or either of surfaces of the printing roll contact bodies and the intaglio roll contact bodies may be formed of metal, or a resin or rubber elastic body 310 can be fitted at both or either of the surfaces of the printing roll contact bodies and the intaglio roll contact bodies (FIG. 6). With the adoption of the resin or rubber elastic body 310, individual size differences brought about when the intaglio roll 4 or the elastic letterpress 31 are exchanged can be absorbed, and moreover metallic abrasion particles which would cause produce failures are eliminated. The printing roll contact bodies and the intaglio roll contact bodies can be totally formed of metal or consist of the resin or rubber elastic body 310.

A material for the elastic body 310 fitted at least at a surface of either of the printing roll contact bodies and the intaglio roll contact bodies may be the same or the same series as that of the elastic letterpress 31 fitted to the printing roll 3. That is, a resin, rubber or the like of completely the same or approximately the same technical characteristics (for instance, values of hardness, reaction force, etc.) as those of the elastic letterpress 31 may be suitably selected and used for the elastic body 310. In such case, a state similar to the contact state between the elastic letterpress 31 fitted to the printing roll 3 and the intaglio roll 4 can be produced before the elastic letterpress 31 fitted to the printing roll 3 and the intaglio roll 4 actually come into contact with each other, and therefore impacts on the occasion of actual contact between the letterpress 31 fitted to the printing roll 3 and the intaglio roll 4 can be effectively prevented. At the same time, size accuracy, reliability, availability, etc. are advantageously satisfied.

Particularly in the case where the elastic body 310 is fitted at the surface of either of the printing roll contact bodies and the intaglio roll contact bodies and the other face of the contact bodies is formed of metal, the contact state between the printing roll contact bodies 300 and the intaglio roll contact bodies 400 is rendered the same as that of the elastic letterpress 31 which is elastic and the intaglio roll 4 having the metallic surface. Accordingly, physical properties such as hardness, reaction characteristics, etc. are uniform, thereby to facilitate adjustment of the devices. The elastic body 310 can be obtained economically by utilization therefor of material remaining after the elastic letterpress 31 is manufactured.

When the elastic body 310 fitted at the surface of the contact bodies 300 or 400 is made exchangeable to change at least one of breadth, thickness and hardness thereof, a contact pressure between the elastic letterpress 31 of the printing roll 3 and the surface of the intaglio roll 4 can be varied. An increase of at least one of the breadth, thickness and hardness of the elastic body 310 can maintain the contact pressure between the elastic letterpress 31 of the printing roll 3 and the surface of the intaglio roll 4 at a small constant value. On the other hand, a decrease of at least one of the breadth, thickness and hardness can keep the contact pressure between the elastic letterpress 31 of the printing roll 3 and the surface of the intaglio roll 4 at a large constant value. When the elastic body 310 is fitted to the surface of the printing roll contact body and no elastic body is fitted to the intaglio roll contact body 400, the thickness of the elastic body 310 set to the printing roll contact bodies 300 can be changed, for instance within an allowance of about to ±1.0 mm, to a distance of surfaces of the printing roll contact body 300 and the intaglio roll contact body 400 without the elastic body being provided. The allowance in thickness of the elastic body of the printing roll contact body 300 may not be larger than ±20% of the thickness of the elastic letterpress 31.

When ink adheres to the intaglio roll contact bodies 400, such ink is accumulated and scatters, thereby rendering the neighborhood dirty. For solving this, a groove part 401 or projecting part 402 may be formed between the intaglio roll contact body 400 and the ink hold part 4*a* at the cylinder part 40 of the intaglio roll 4 to prevent the ink from flowing to the contact body 400 from the ink hold part 4*a* (FIGS. 4, 5).

Figure 12A:
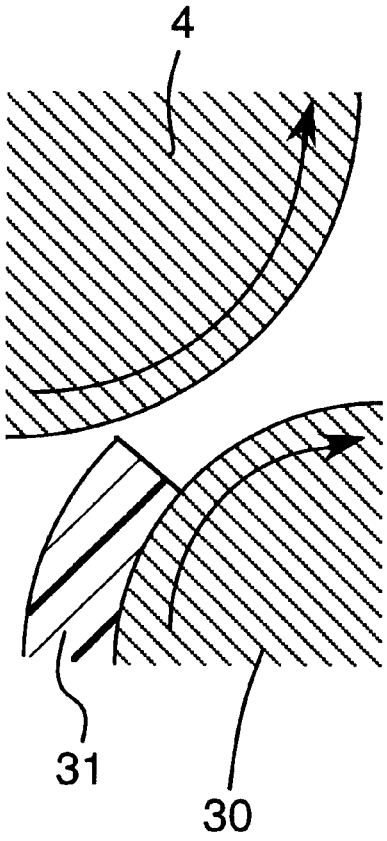
FIGS. 12A and 12B are diagrams explanatory of a non-contact state between a printing roll and an intaglio roll of the conventional thin film formation apparatus and a state when contact is started therebetween.
Figure 12B:
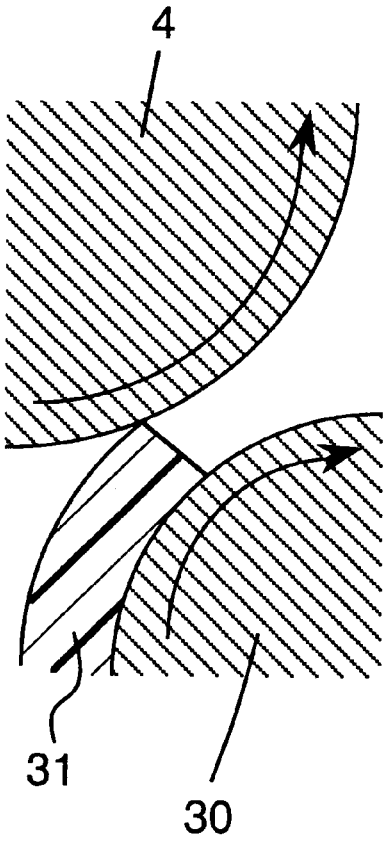

In the thin film formation apparatus of the above embodiments of the present invention, the printing roll contact bodies 300 are arranged to be continuously in contact with the intaglio roll contact bodies 400 at least before the elastic letterpress 31 comes into contact with the intaglio roll 4 and all during such contact. The contact bodies 300 and 400 can be held in contact with each other prior to the contact of the printing image part of the letterpress 3 1 of the printing roll 3 with the intaglio roll 4. More specifically, before the printing image part of the elastic letterpress 31 of the printing roll 3 comes into contact with the intaglio roll 4, the rotary shaft 6 of the printing roll 3 or/and the intaglio roll 4 can be pressed toward the inner rings of the bearings thereof to bend the roll to a bending limit thereof, so that a distance between the rotary shafts of the printing roll 3 and the intaglio roll 4 inwardly of contact bodies 300 or 400 can be kept constant. Owing to such arrangement, impacts when the intaglio roll 4 and the printing image part on the printing roll 3 are changed from the non-contact state (FIGS. 1, 3 12A) to the contact state (FIGS. 12B, 2, 4, 5) are eliminated, and subsequent microscopic bending is lessened.

A liquid crystal orientation film is printed under the following conditions with the use of the thin film formation apparatus according to the embodiment of FIG. 6 of the present invention.

| | |
|---|---|
| Intaglio roll (Anilox roll) | 180 mm diameter |
| Cylinder part of printing roll | 250 mm diameter (including elastic letterpress of 2.84 mm thickness × 2) |
| Elastic letterpress | APR letterpress by Asahi Kasei Inc. |
| Intaglio roll contact body | 180 mm diameter (50 mm breadth) |
| Printing roll contact body | 250 mm diameter (including elastic body of 2.84 mm thickness × 2, 50 mm breadth) |
| Body to be printed (glass) | 370 mm height × 480 mm breadth × 1.1 mm thickness with transparent conductive film |

Figure 11:
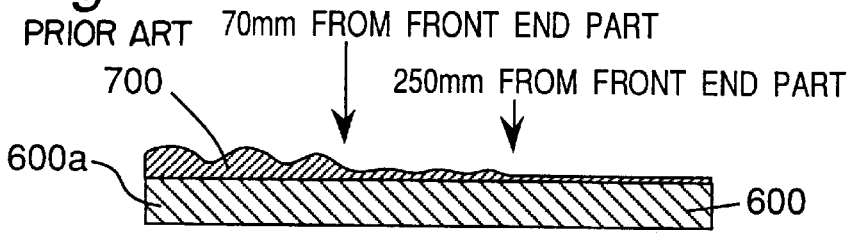
Fig.11 PRIOR ART
FIG. 11 is a sectional view of a glass substrate printed as a comparative example by the conventional thin film formation apparatus.

A comparison example is the apparatus without using the intaglio roll contact body and printing roll contact body. Appearances of printed samples are evaluated with interference colors, and thicknesses are measured for comparison of the examples. In the comparison example, the amount that the elastic letterpress is pressed-in is reduced in a range of 70 mm from a front end part 600*a* of a glass substrate 600, and therefore a part having a larger film thickness than other parts is produced in a liquid crystal orientation film 700 on the printed glass substrate 600. In addition, stripe patterns are observed due to a thickness change because of vibrations of the rolls in a range of 250 mm from the front end part (FIG. 11). A thickness accuracy of the printed film on the substrate is 8%.

Figure 13:
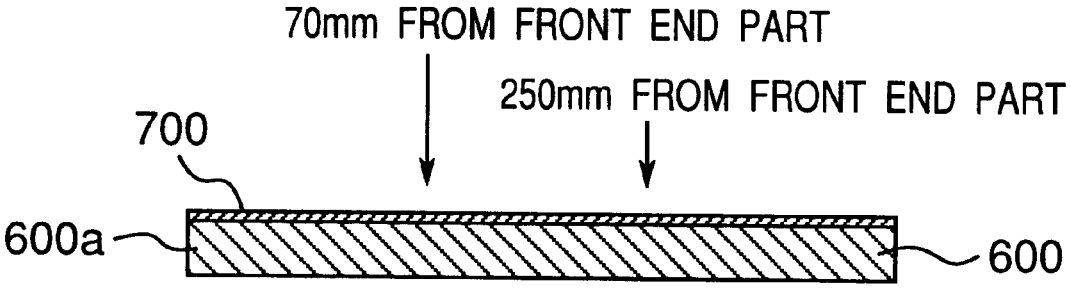
FIG. 13 is a sectional view of a glass substrate printed by the thin film formation apparatus in the embodiment shown in FIG. 6 of the present invention.

In contrast, in the same evaluation tests of the sample according to the invention, a thicker part than the other parts is not present in a range of 70 mm from a front end of the substrate, the rolls are vibrated to a lesser extent and stripe patterns resulting from film thickness changes subsequent to the vibrations are reduced in a range of 250 mm from the front end. The printed film according to the invention has a thickness accuracy of ±6% on the substrate (referring to FIG. 13).

When thin film formation is performed on the glass substrate under the above conditions, a thin film with a uniform thickness can be formed.

As discussed hereinabove, in the invention, the printing roll contact bodies 300 and the intaglio roll contact bodies 400 are arranged to be in contact with each other continuously, at least before the contact of the elastic letterpress 31 with the intaglio roll 4 and all during such contact. Thus, although the rotary shaft 6 outside the pair of printing roll contact bodies 300 or/and the rotary shaft 6 outside the pair of intaglio roll contact bodies 400 is bent because of stress due to the contact of the contact bodies 300 and 400 even before the printing image part of the elastic letterpress 31 starts to touch the intaglio roll 4, the cylinder part 30 or the rotary shaft 6 inside the pair of printing roll contact bodies 300, or/and the cylinder part 40 or the rotary shaft 6 inside the pair of intaglio roll contact bodies 400 is difficult to bend. Moreover, because of the stress caused by the contact of the contact bodies 300 and 400, the printing roll 3 and the intaglio roll 4 are pressed in opposite directions to directions in which the rolls are pressed into contact with each other, by the amount of a play of the bearings 5 and a play 100 between rotary shaft 6 at the bearing part of the bearing 5 and the inner ring of the bearing 5, whereby such play actually is decreased.

Before the printing image part of the elastic letterpress 31 starts to touch the intaglio roll 4, the bend and the play of the printing roll 3 and the cylinder part 40 of the intaglio roll 4 are lessened owing to the presence of pairs of the printing roll contact bodies 300 and the intaglio roll contact bodies 400, as depicted hereinabove. At the same time, before the start of the contact between the printing image part of the elastic letterpress 31 an the intaglio roll 4, the contact state therebetween is reproduced because of the contact of the pairs of the printing roll contact bodies 300 and the intaglio roll contact bodies 400. Therefore, a change in the contact pressure due to impacts mainly when the printing image part of the printing roll 3 starts to contact the ink hold part 4*a* of the intaglio roll 4 (referring to FIG. 12B) is eased, and stripe patterns (alternate appearance of parts where the amount of transferred ink or film thickness is large and small) spaced in an axial direction of the rolls are prevented from being formed on the elastic letterpress 31 or the body 156 to be printed. Also a change of the contact pressure between the printing image part of the printing roll 3 and the body 156 to be printed is eased similarly, so that the stripe patterns due to this change of the contact pressure therebetween are avoided.

According to the present invention, since contact members coming in contact prior to the patterns of the elastic letterpress, for example, the above-described contact bodies are provided between the intaglio roll and the printing roll, vibrations of both rolls during printing can be restricted and a pressure of the elastic letterpress is stabilized, thereby to reduce print irregularities resulting from film thickness changes.

The entire disclosure of Japanese Patent Application No. 8-87294 filed on Mar. 15, 1996, including specification, claims, drawings, and summary are incorporated herein by reference in its entirety.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A thin film formation apparatus comprising:

a printing roll having extending over a portion of a periphery thereof a resin or rubber elastic letterpress;

an intaglio roll mounted to transfer ink to said elastic letterpress through contact therewith;

at least one printing roll contact body provided at said printing roll, and at least one intaglio roll contact body provided at said intaglio roll, said at least one printing roll contact body and said at least on intaglio roll contact body being located at respective positions to absorb or ease contact impact resulting prior to contact between said elastic letterpress and said intaglio roll; and at least one of said printing roll contact body and said intaglio roll contact body having on a peripheral surface thereof a resin or rubber elastic body.

2. An apparatus as claimed in claim 1, wherein said resin or rubber elastic body is on said printing roll contact body.

3. An apparatus as claimed in claim 2, wherein said resin or rubber elastic body extends along a portion only of said peripheral surface of said printing roll contact body.

4. An apparatus as claimed in claim 3, wherein said portion extends at least from just prior to beginning contact of said elastic letterpress with said intaglio roll to at least just after ending of contact of said elastic letterpress with said intaglio roll.

5. An apparatus as claimed in claim 1, wherein said at least one printing roll contact body comprises a pair of printing roll contact bodies on a cylinder part of said printing roll or a rotary shaft thereof, and said at least one intaglio roll contact body comprises a pair of intaglio roll contact bodies on a cylinder part of said intaglio roll or a rotary shaft thereof, and said pair of printing roll contact bodies are in contact with respective of said pair of intaglio roll contact bodies continuously at least before said elastic letterpress comes into contact with said intaglio roll and throughout such contact, thereby absorbing or easing contact impact between said elastic letterpress and said intaglio roll.

6. An apparatus as claimed in claim 5, wherein a stress resulting from said contact between said pair of printing roll contact bodies and said pair of intaglio roll contact bodies prevents, before contact of said elastic letterpress with said intaglio roll, bending of said cylinder part or said rotary shaft of said printing roll between said pair of printing roll contact bodies, and bending of said cylinder part or said rotary shaft of said intaglio roll of said intaglio roll between said pair of intaglio roll contact bodies.

7. An apparatus as claimed in claim 6, wherein said stress presses said printing roll and said intaglio roll in respective directions opposite to respective directions in which said printing roll and said intaglio roll are pressed toward each other, by an amount of play of bearings supporting said rotary shaft of said printing roll and of bearings supporting said rotary shaft of said intaglio roll, and by an amount of play between each said rotary shaft and bearing parts of respective said bearings and inner rings of said respective bearings, thereby reducing such play.

8. An apparatus as claimed in claim 5, wherein a stress resulting from said contact between said pair of printing roll contact bodies and said pair of intaglio roll contact bodies, before contact of said elastic letterpress with said intaglio roll, presses said printing roll and said intaglio roll in respective directions opposite to respective directions in which said printing roll and said intaglio roll are pressed toward each other, by an amount of play of bearings supporting said rotary shaft of said printing roll and of bearings supporting said rotary shaft of said intaglio roll, and by an amount of play between each said rotary shaft and bearing parts of respective said bearings and inner rings of said respective bearings, thereby reducing such play.

9. An apparatus as claimed in claim 5, further comprising projections positioned between and extending outwardly beyond said intaglio roll and respective said intaglio roll contact bodies, thereby preventing ink from said intaglio roll from passing to said intaglio roll contact bodies.

10. An apparatus as claimed in claim 5, further comprising inwardly extending grooves positioned between said intaglio roll and respective said intaglio roll contact bodies, thereby preventing ink from said intaglio roll from passing to said intaglio roll contact bodies.

11. An apparatus as claimed in claim 5, wherein each of said printing roll contact bodies has on a peripheral surface thereof a respective said resin or rubber elastic body.

12. An apparatus as claimed in claim 11, wherein each of said intaglio roll contact bodies has on a peripheral surface thereof a respective said resin or rubber elastic body.

13. An apparatus as claimed in claim 5, wherein each of said intaglio roll contact bodies has on a peripheral surface thereof a respective said resin or rubber elastic body.

14. An apparatus as claimed in claim 1, wherein said resin or rubber elastic body is formed of the same material or same series material as said elastic letterpress.

15. An apparatus as claimed in claim 1, wherein said resin or rubber elastic body is fitted in an exchangeable manner on said peripheral surface, whereby a contact pressure between said elastic letterpress and said intaglio roll is adjustable by changing at least on of a breadth, a thickness and a hardness of said resin or rubber elastic body.

* * * * *